United States Patent [19]

Hudson

[11] Patent Number: 4,738,363

[45] Date of Patent: Apr. 19, 1988

[54] BEVERAGE CAN CONTAINER

[76] Inventor: Kirby A. Hudson, 739 Meadow St., Mamaroneck, N.Y. 10543

[21] Appl. No.: 937,712

[22] Filed: Dec. 4, 1986

[51] Int. Cl.[4] ..... B65D 5/36

[52] U.S. Cl. ..... 206/427; 383/6; 383/38

[58] Field of Search ..... 206/427, 430; 383/38, 383/6

[56] References Cited

U.S. PATENT DOCUMENTS 4,463,789 8/1984 Leiserson ..... 383/38

4,542,826 9/1985 Adams ..... 206/437

*Primary Examiner*—Joseph Man-Fu Moy

*Attorney, Agent, or Firm*—Lackenbach Siegel Marzullo & Aronson

[57] ABSTRACT

A container for storing and transporting empty beverage cans of similar cylindrical dimensions. A cover for the container can be sealed shut so as to secure the compartment in which the cans are stored against the entry of vermin during the time the cans are stored prior to transporting them to a retail store for return of deposit. The cover can be partially integral with the top edge of one wall of the container with the cover being connected with the top edges of the other walls by an easily removable continuous seal such as a zipper or a snag-and-hook fastener. The sealable cover can alternatively be completely removable from the top of the container with the continuous seal extending completely around the cover and the top of the container. The container is made of a washable, lightweight, waterproof material. At least one wall of the container is and may be transparent. A carrying strap or handle is provided, adjustable, as is conventional and well known.

7 Claims, 2 Drawing Sheets

FIG. 2
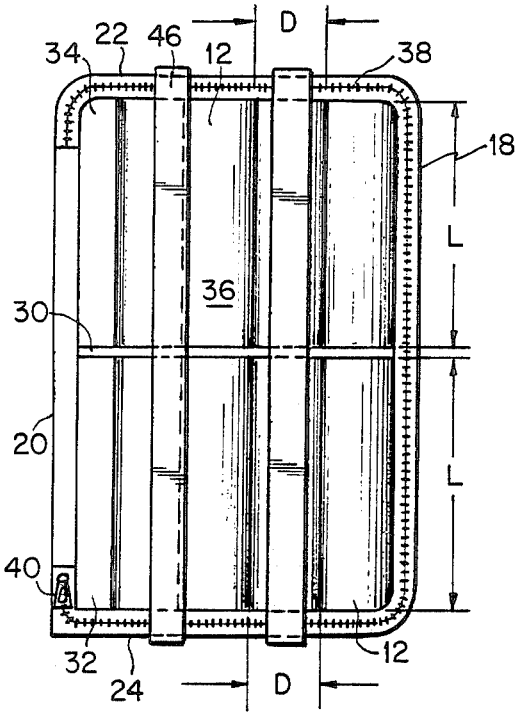
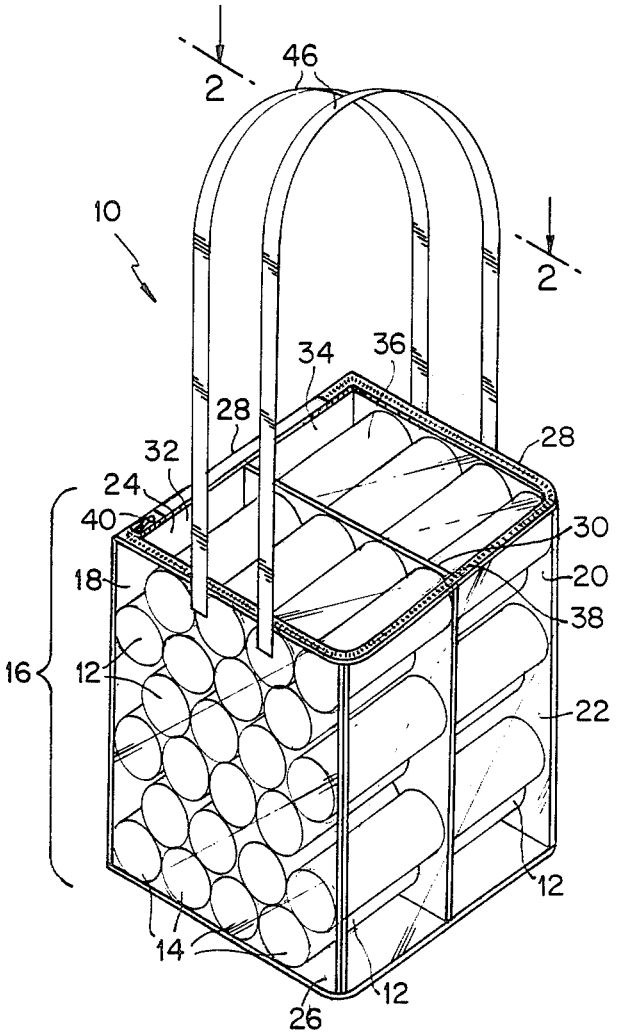
FIG. 1
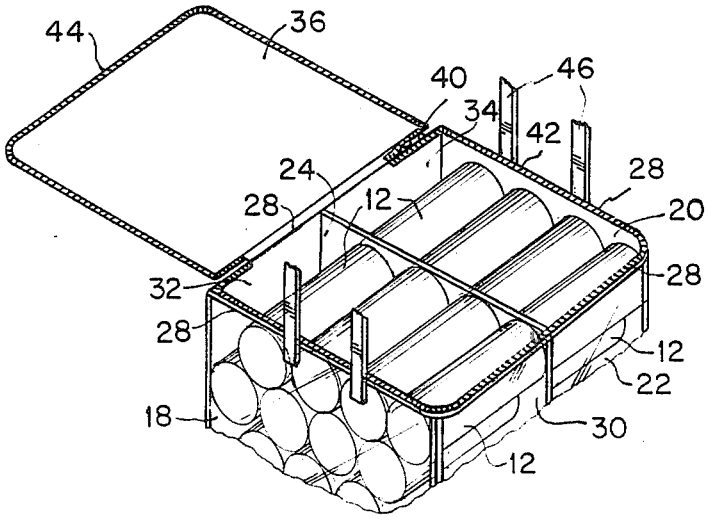
FIG. 3

BEVERAGE CAN CONTAINER

BACKGROUND OF THE INVENTION

This invention relates generally to returnable beverage can containers.

In order to help with the problem of waste disposal, many states have made laws requiring retail stores to receive empty cans and bottles and to refund the deposit on each. The most common type of cans returned are 16 ounce cylindrical cans having substantially the same general diameters and lengths.

Containers have been devised to store and hold the cans. A problem of these containers is that a number of the empty cans are accumulated and stored prior to transporting them to a retail store for the return of the deposit. Empty beverage cans generally have small top openings and are therefore difficult to clean well and so tend to attract vermin, primarily various types of insects.

A number of U.S. patents that have been issued that describe various types of empty beverage can containers are as follows:

(1) U.S. Pat. No. 4,214,660 issued to Hunt on July 29, 1980. Hunt describes an empty can container that is analogous to the packages for holding full cans on sale such as the six or twelve pack container. Inspection holes are positioned over each can.

(2) U.S. Pat. No. 4,290,525 issued to Sisson on Sept. 22, 1981. Sisson describes a transparent carrier for empty beverage cans that is constructed so as to show some of the cans for inspection and allows quick counting of all of them. This invention seems to be primarily directed to the container having a base stiffener panel and pleated end panels to allow the container to be folded around the base panel for storage of the container.

(3) U.S. Pat. No. 4,299,324 issued to Dickens on on Nov. 10, 1981. Dickens describes a collapsible compartmented container made of sheet plastic for returnable beverage cans.

(4) U.S. Pat. No. 4,417,657 issued to Thibodeau on Nov. 29, 1983. Thibodeau describes an open top container that has chambers for holding the can in vertical stacks.

(5) U.S. Pat. No. 4,542,826 issued to Adams on Sept. 24, 1985. Adams describes a flexible, transparent bag having vertical compartments for receiving beverage cans.

(6) U.S. Pat. No. 4,574,978 issued to Hodges on Mar. 11, 1986. Hodges describes a can container that includes a transparent, flexible pouch and a rigid housing in which the pouch is slidably received. Hodges further describes a removable cover for covering the container during transportation and also a flap for covering the pouch during storage.

None of the described containers is capable of keeping out vermin so as to prevent them from entering the empty cans during the storage phase of the empty cans.

SUMMARY OF THE INVENTION

It is an object of this invention to provide a container for holding and transporting empty beverage cans that cannot be entered by vermin.

It is another object of this invention to provide a container for holding and transporting empty beverage cans that is transparent so as to allow easy counting of the cans and that is sealable against entry by vermin.

It is another object of this invention to provide a container for holding and transportation that is easily washed and is also sealable against entry by vermin.

In accordance with these and other objects that will become apparent in the course of this disclosure, there is provided a container for storing and transporting empty beverage cans of similar cylindrical dimensions. A cover for the container can be sealed shut so as to secure the compartment in which the cans are stored against the entry of vermin during the time the cans are stored prior to transporting them to a retail store for return of deposit. The cover can be partially integral with the top edge of one wall of the container with the cover being connected with the top edges of the other walls by an easily removable continuous seal such as a zipper or a snag-and-hook fastener. The sealable cover can alternatively be completely removable from the top of the container with the continuous seal extending completely around the cover and the top of the container. The container is made of a washable, lightweight, waterproof material. At least one wall of the container is transparent. A carrying strap or handle is provided.

BRIEF DESCRIPTION OF THE DRAWINGS

FIG. 1 is a perspective view of a covered container for holding and transporting empty beverage cans that is filled with empty cans with the container cover being closed and sealed by a zipper;

FIG. 2 is a top view of the container taken across plane 2—2 in FIG. 1;

FIG. 3 is a partial perspective view of the container shown in FIG. 1 with the container cover open;

DETAILED DESCRIPTION OF THE PREFERRED EMBODIMENTS

Figure 5:
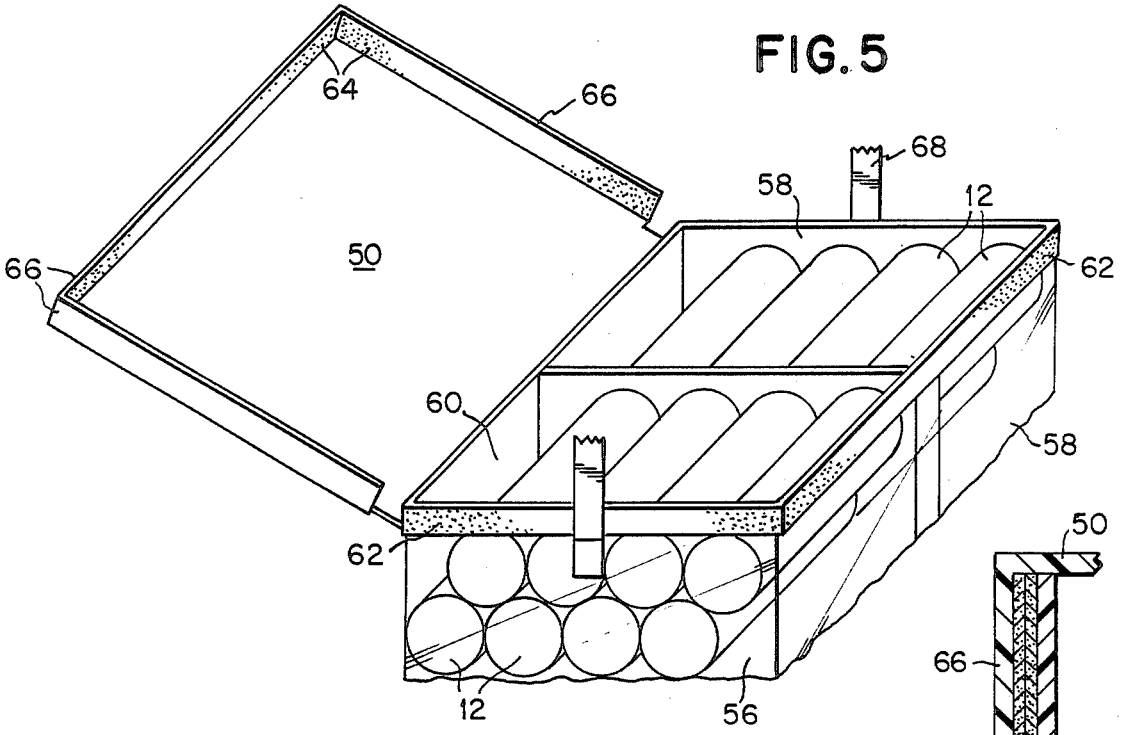
FIG. 5 is a partial perspective view of the container shown in FIG. 4 with the container cover open.

Reference is now made in detail to the drawings where identical or similar elements are identified by the same numerals.

A beverage container system 10 shown in FIGS. 1–3 holds a number of empty, similarly dimensioned, cylindrical beverage cans 12 each having a length L and opposed circular ends 14 having a diameter D. System 10 includes a container 16 having opposed end walls 18 and 20, opposed side walls 22 and 24 connected to the end walls, and a bottom wall 26 connected to the side and end walls. End walls 18 and 20 and side walls 22 and 24 have equal heights and form a continuous container top edge 28. End walls 18 and 20 are distanced apart two can lengths so as to position two of cans 12 end-to-end lengthwise between end walls 18 and 20. Side walls 22 and 24 are distanced apart four diameters D so as to position four cans 14 horizontally side by side between the side walls. The height of end walls 18 and 22 and side walls 24 and 26 is six diameters D so as to position six tiers of cans 12 vertically. Thus, container 16 holds a total of 48 cans 12. A middle interior wall 30 is positioned one length L from each of end walls 18 and 20 and extends between bottom wall 26 and top edge 28 of side walls 22 and 24 so that two separate compartments 32 and 35 of equal dimensions and capacity are formed in container 16 capable of storing an equal number of cans 12.

A top cover wall 36 positioned opposed to bottom wall 26 is sealingly connected to end and side walls 18, 20 and 22, 24 along continuous top edge 28 in FIG. 1. In particular, cover wall 36 is integral with the top edge of side wall 24 and is shown in its closed position in FIG. 1 sealingly connected to the top edge of end walls 18 and 20 and of side wall 22 by a continuous zipper fastener 38 with the zipper tab 40 with the zipper sliding piece shown at the top of end wall 18 next to side wall 24. Cover wall 36 is shown in its open position in FIG. 3 with one row of zipper teeth 42 shown along the top edges of end walls 18 and 20 and side wall 22, and the other row of zipper teeth 44 shown along the mating sides of cover wall 36. Zipper tab 40 is shown alongside zipper teeth 44 at the junction of end wall 20 and side wall 24. A double-strap handle 46 is attached to end walls 18 and 20. Reinforcing is added to the juncture of the end, side, and bottom walls of container 16.

Container 16 is made of a flexible, washable, lightweight, and water resistant, leak-proof material, such as plastic. The continuous zipper sealing is resistant to the entry of insects into the container during storage of the empty cans in the container. The cans can easily be counted at the store through the transparent container.

The cans shown in FIGS. 1–3 are the standard 12 ounce cylindrical beverage cans used by manufacturers of many different types and brands of beverages. The invention ia applicable to other types of cans of equal size.

Figure 6:
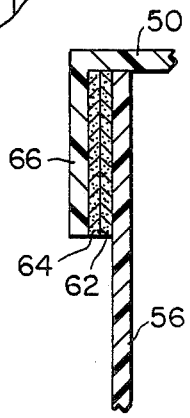
FIG. 6 is a sectional view taken through plane 6—6 in FIG. 4.
Figure 4:
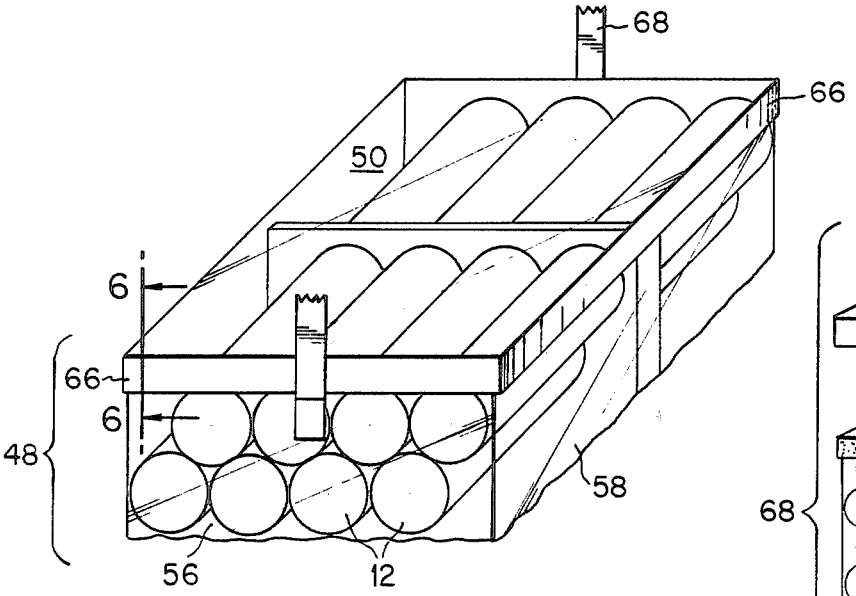
FIG. 4 is a perspective view of a covered beverage can container being closed and sealed by a snag-and-hook device.

FIGS. 4–6 illustrate another embodiment of the invention. A container 48 similar to container 16 of FIGS. 1–3 holding cans 12 has a cover wall 50 similar to cover wall 36 of the embodiment illustrated in FIGS. 1–3. Cover wall 50 seals top edge 52 of opposed end walls 54 and 56 and opposed side wall 58 and 60 of the container by being integral with the top edge of side wall 60 and by sealing the top edges of end walls 54 and 56 and side wall 58 by a snag-and-hook fastener. FIG. 4 shows cover wall 50 in its closed position and FIG. 5 shows cover wall 50 in its open position with the snag-and hook fastener exposed. In particular, one continuous element 62 of the snag-and-hook fastener is shown attached to the top outer rim surface of end walls 54 and 56 and side wall 58, and another continuous element 64 of the snag-and-hook fastener is shown attached to the inner surface of a flanged rim 66 extending from the three edges of cover wall 50 that are positioned immediately outside end walls 54 and 56 and side wall 58 in contact with continuous element 62 when cover wall 50 is in its closed position as shown in FIG. 4. A single-strapped handle 68 is attached to end walls 54 and 56. Only end walls 56 and 58 are transparent. End walls 56 can be made of plastic and side walls 58 and 60, cover wall 50, and the bottom wall (not shown) can be made of a lightweight, waterproof material that is somewhat stronger than transparent, preferably plastic, end walls 56 and 58.

Figure 7:
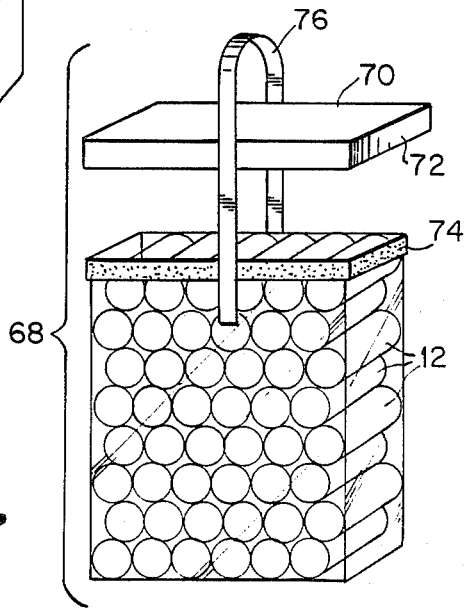
FIG. 7 is a perspective view of another embodiment of the invention.

Another embodiment is shown in FIG. 7, which illustrates a container 68 including opposed side and end walls forming a single compartment. Here, eight tiers of six cans 12 each are positioned in the single compartment. A cover wall 70 having a continuous flanged rim 72 is shown completely separated from the end and side walls. One element 74 of a snag-and-hook fastener shown extending around the outer top rim surface of the side and end walls is adapted to connect to the other element of the snag-and-hook fastener on the inside surface of flanged rim 72. A handle 76 is connected to the end walls of the container.

The embodiment of the invention particularly disclosed and described herein is presented merely as an example of the invention. Other embodiments, forms, and modifications of the invention coming within the proper scope and spirit of the embodied claims will, of course, readily suggest themselves to those skilled in the art.

What is claimed is:

1. A reusable beverage container system for storing and transporting a plurality of similarly dimensioned cylindrical empty beverage cans each having a length and opposed circular ends each having a diameter, comprising, in combination, a container having opposed end walls, opposed side walls connected to said end walls, and a bottom wall connected to said end and side walls, said side and end walls each having a height and having a continuous container top edge, said end walls being distanced apart substantially two of the lengths so as to position two of the cans end-to-end lengthwise between said end walls, said side walls being distanced apart substantially a plurality of said diameters of the circular ends so as to position a plurality of the cans horizontally between said side walls, said height being substantially that of a plurality of said diameters so as to vertically position a plurality of the cans in tiers, cover means opposite said bottom wall for covering said container during storing and transporting, said cover means being movable between open and closed positions, wherein in said closed position said cover is connected to said continuous container edge and in said open position said cover is removed from at at least a portion of said continuous container edge so as to allow passage of the cans into and from said container, continuous sealing means associated with said cover means and with said continuous top edge for sealing said container against entry by vermin when said cover means is in said closed position, said side wall, said end wall, said bottom wall, and said cover means being made of a washable material, said material being flexible and transparent, and a middle interior wall positioned at one length from each of said end walls and extending between said bottom wall and said top edge at said side walls, wherein two separate compartments of equal storage capacity are formed in said container, each compartment being capable of storing an equal number of the cans.

2. The system according to claim 1, wherein said material is plastic.

3. The system according to claim 1, wherein said cover means is a top cover wall associated with said continuous edge and capable of being moved between said open and closed positions.

4. The system according to claim 3, wherein said cover wall has a continuous cover edge that is associated with said continuous container edge when said cover wall is in said closed position, and wherein said continuous sealing means is a zipper associated with said at least a portion of said continuous container edge and with a mating portion of said continuous cover wall.

5. The system according to claim 1, wherein said cover wall has a continuous cover edge that is associated with said continuous container edge when said cover wall is in said closed position, and wherein said continuous sealing means is a snag-and-hook sealing connector associated with said at least a portion of said continuous container edge and with a mating portion of said continuous cover wall.

6. The system according to claim 1, wherein said continuous container edge includes said at least a portion of said container edge and another portion of said container edge, said cover means being hingedly mounted to said container at said another portion.

7. The system according to claim 1, further including a handle attached to said container.

* * * * *